US007775509B2

(12) United States Patent
Langenegger et al.

(10) Patent No.: US 7,775,509 B2
(45) Date of Patent: Aug. 17, 2010

(54) METHOD AND ARRANGEMENT FOR PRODUCING DIGITALLY PRINTED NEWSPAPERS

(75) Inventors: Daniel Langenegger, Brittnau (CH); Heinz Boss, Strengelbach (CH)

(73) Assignee: Mueller Martini Holdings AG, Hergiswil (CH)

( * ) Notice: Subject to any disclaimer, the term of this patent is extended or adjusted under 35 U.S.C. 154(b) by 577 days.

(21) Appl. No.: 11/520,853

(22) Filed: Sep. 14, 2006

(65) Prior Publication Data

US 2007/0063407 A1 Mar. 22, 2007

(30) Foreign Application Priority Data

Sep. 14, 2005 (EP) ..... 05405540

(51) Int. Cl.
*B65H 37/04* (2006.01)

(52) U.S. Cl. ..... 270/21.1; 270/4; 270/5.02; 270/10; 270/11; 270/12; 270/13; 270/15; 270/16; 270/17; 270/18; 270/19; 270/20.1; 270/43; 270/44; 270/45; 270/46; 270/47; 270/52.07; 270/52.09; 270/52.16; 270/52.17; 270/52.18; 270/52.26; 270/52.29; 270/58.07

(58) Field of Classification Search ..... 270/4, 270/5.02, 10, 11, 12, 13, 14, 15, 16, 17, 18, 270/19, 20.1, 21.1, 43, 44, 45, 46, 47, 52.07, 270/52.09, 52.12, 52.16, 52.17, 52.18, 52.26, 270/52.29, 56, 58.07
See application file for complete search history.

(56) References Cited

U.S. PATENT DOCUMENTS 4,221,373 A 9/1980 Hans
4,863,152 A * 9/1989 Milo ..... 270/47
5,030,193 A * 7/1991 Breton et al. ..... 493/458
5,622,268 A * 4/1997 Conner et al. ..... 209/603
6,719,283 B2 * 4/2004 Tsuchiya et al. ..... 270/58.07
2003/0214092 A1 * 11/2003 Horii et al. ..... 270/52.18

FOREIGN PATENT DOCUMENTS

| | | | |
|---|---|---|---|
| CH | 615 646 | A5 | 2/1980 |
| EP | 0 992 365 | A1 | 4/2000 |
| EP | 1 197 456 | A1 | 4/2002 |
| EP | 1 209 000 | A1 | 5/2002 |
| GB | 1 205 581 | A | 9/1970 |
| WO | WO 02/078974 | A1 | 10/2002 |

OTHER PUBLICATIONS

Berger P: "Investing With View to Digital Niche Products" Deutscher Drucker, vol. 34, No. 35, pp. w45, w48.
European Search Report dated Jun. 6, 2006, issued in EP 05405540.5.

* cited by examiner

*Primary Examiner*—Gene Crawford
*Assistant Examiner*—Leslie A Nicholson, III
(74) *Attorney, Agent, or Firm*—Venable LLP; Robert Kinberg; Leigh D. Thelen

(57) ABSTRACT

A method and apparatus for producing a digitally printed product that includes at least one section of sequentially printed sheets folded approximately in the center. The sequentially printed sheets are conveyed one after another on a conveying device and folded inside a folding apparatus to form a first fold. The folded sheets are gathered in a gathering station to form a section which is fed to a work station where the section is folded approximately in the center to form a second fold.

34 Claims, 10 Drawing Sheets

METHOD AND ARRANGEMENT FOR PRODUCING DIGITALLY PRINTED NEWSPAPERS

CROSS-REFERENCE TO RELATED APPLICATIONS

This application claims the priority of European Patent Application No. 05405540.5, filed on Sep. 14, 2005, the subject matter of which is incorporated herein by reference, along with all other patents and patent applications, U.S. or foreign, which are referenced herein.

BACKGROUND OF THE INVENTION

The invention relates to a method for producing digitally printed products, comprising at least one newspaper section composed of sequentially printed sheets, which are folded in the center. The invention furthermore relates to an arrangement for realizing said method.

Newspaper production methods are not new. Traditionally, newspapers were produced with the offset or gravure printing technique by imprinting paper webs or large sheets on both sides, which are then combined to form a newspaper section. These days, newspapers are produced with the aid of digital printers, which allow the sequential printing of individual sheet sections in such a way that a complete newspaper is obtained at the end. Different newspapers can thus be printed in an optional sequence, and it is furthermore possible to print newspapers one after another in the so-called broadsheet format and the tabloid format.

European Patent Application Publication EP 1 209 000 A discloses a method for which individual flat sheets are gathered and are then folded while positioned loosely one on top of the other. However, the aligning and folding of such sheets of freshly printed newspaper is very difficult in practical operations.

SUMMARY OF THE INVENTION

It is an object of the present invention to develop a method of the aforementioned type which avoids this difficulty.

The above and other objects are accomplished according to the invention by the provision of a method for producing a digitally printed product that includes at least one section (also referred to as stack or bundle) of sequentially printed sheets folded approximately in the center. According to one exemplary embodiment, the method comprises: folding the sequentially printed sheets, which are conveyed one after another on a conveying device, inside a folding apparatus to form a first fold; gathering the folded sheets in a gathering station to form a section; and feeding the section to a work station and folding the section in the work station approximately in the center to form a second fold.

Thus, the method according to the invention includes individually folding the sequentially printed sheets in a folding apparatus, gathering and compiling the folded sheets in a gathering station into a section, and supplying this section to a work station where it is folded approximately in the center. With this method, the folded sheets can be aligned while the newspaper section is formed, which is possible even with large sheets of newly printed newspaper. The foregoing method is suitable for producing extremely thick newspapers.

According to one exemplary embodiment of the invention, a continuous paper web is printed on and is then cut, preferably with a crosscutter, so that sheets are formed and are preferably ordered sequentially.

Prior to the gathering operation, the separated sheets can be folded in a folding apparatus, preferably a continuous folding apparatus.

A particularly secure and reliable gathering of the folded sheets is possible if the sheets are gathered on a non-moving gathering chain. For this, the sheets are preferably pushed against an adjustable end stop and are gathered until a complete newspaper section is obtained.

According to another exemplary embodiment of the invention, the gathering station is provided with an extendable sword for holding back the sheets just long enough to allow a completely gathered newspaper section to be conveyed further, thus making possible a continuous production.

A further exemplary embodiment of the invention provides that the gathered newspaper section is processed further while arranged at an angle, thereby permitting an advantageous alignment of the newspaper section against end stops due to the forces of gravity.

Yet another exemplary embodiment of the invention is provided with a first work station, which comprises at least one trimming knife and/or a stitching unit for producing a tabloid. To produce a tabloid, the newspaper section is preferably trimmed and simultaneously stitched along the fold in this first work station. Newspaper sections of very different thicknesses can thus be stitched without requiring a complicated electric-motor adjustment by combining the press crosshead and the trimming device with the operation of the bending units for the stitching apparatus. In this way, tabloids with formats trimmed to different dimensions can thus be produced with a quick change in the trimming length and by varying the trimming in this first work station.

According to another exemplary embodiment of the invention, a second work station is provided for folding one or several newspaper sections. When producing a newspaper in the broadsheet format, this fold is the second fold, whereas it is the first fold for producing a tabloid.

According to yet another exemplary embodiment of the invention, a complete newspaper is assembled from several newspaper sections that are gathered, for example, inside circulating pockets or in a star-shaped delivery device.

Additional advantageous features follow from the patent claims, the description below, as well as the drawings.

BRIEF DESCRIPTION OF THE DRAWINGS

These and other features and advantages of the invention will be further understood from the following detailed description of the exemplary embodiments with reference to the accompanying drawings. The drawings show.

DETAILED DESCRIPTION OF EXEMPLARY EMBODIMENTS

Figure 1:
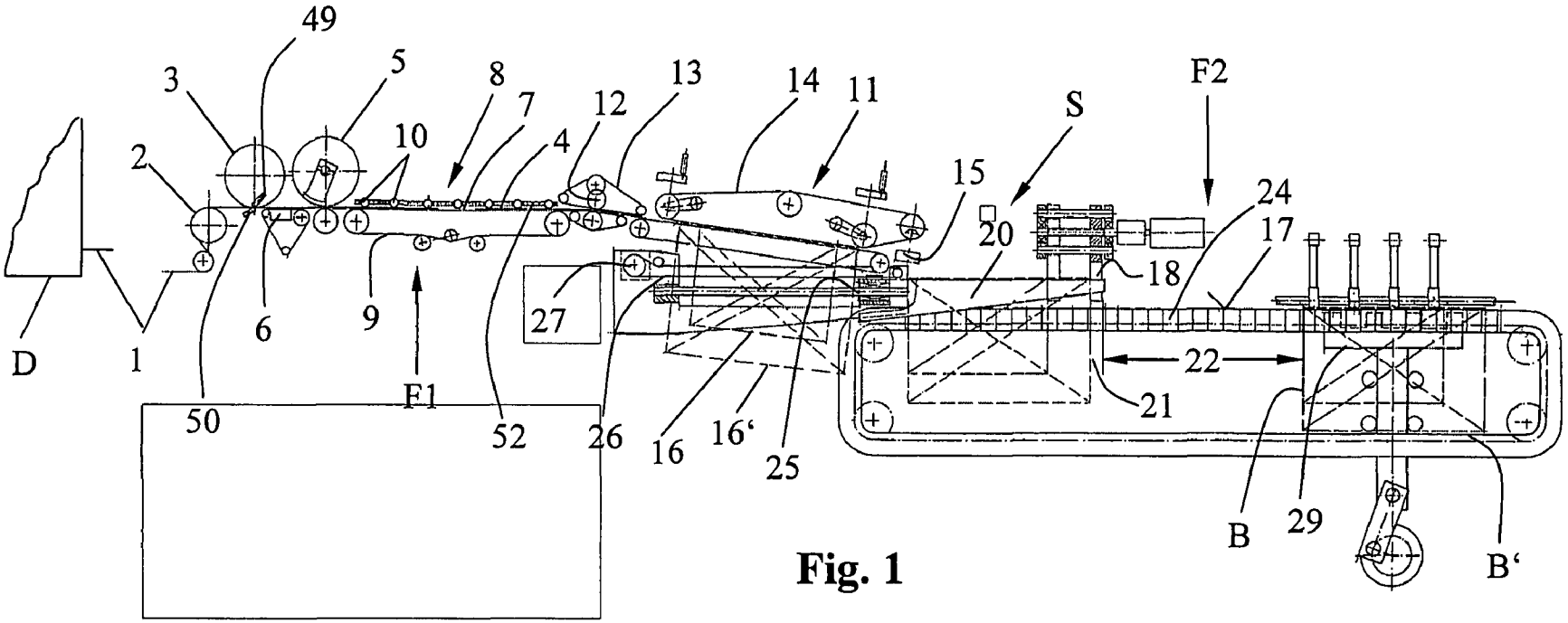
FIG. 1: A schematic side view of the apparatus according to an exemplary embodiment of the invention.
Figure 2:
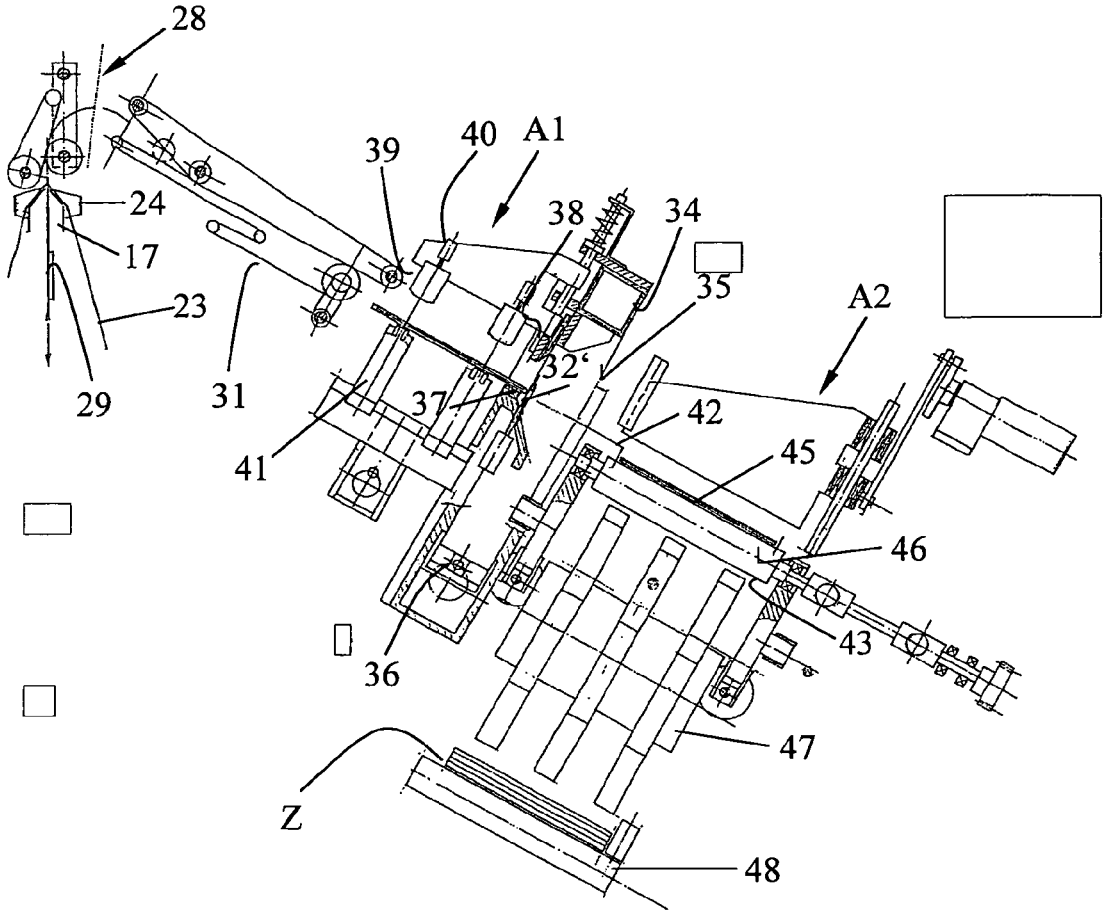
FIG. 2: A schematic side view of a back region of the apparatus according an exemplary embodiment of the invention.
Figure 3:
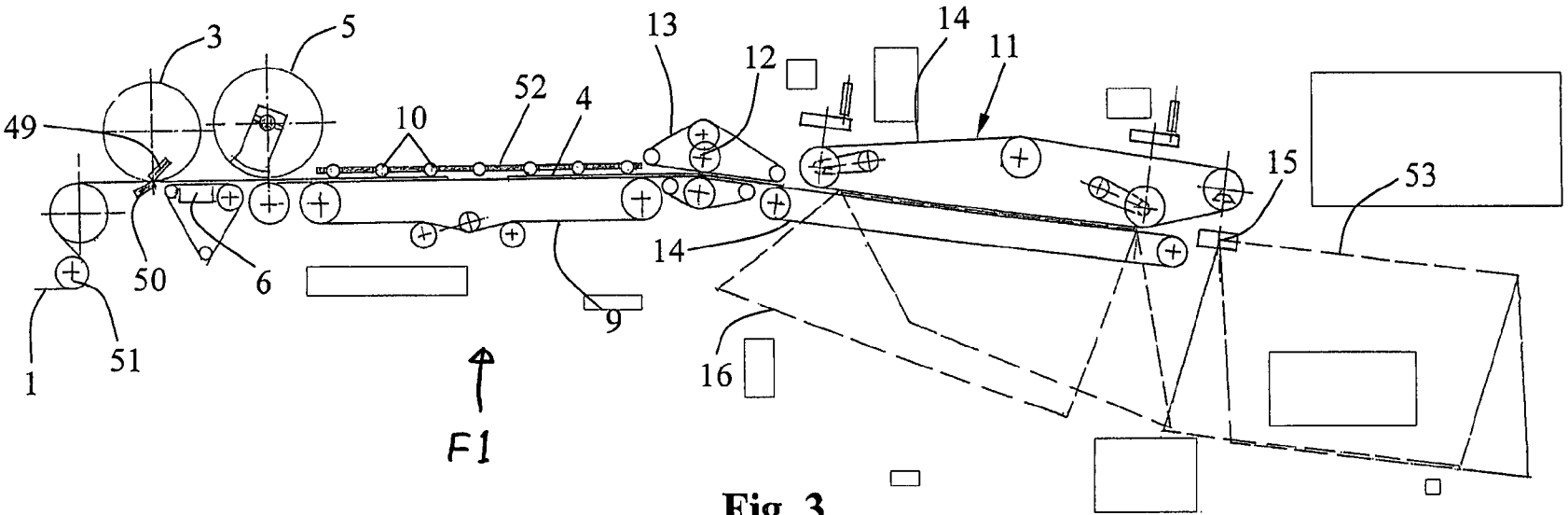
FIG. 3: An enlarged view of a portion of the apparatus as depicted in FIG. 1.

A region of the arrangement according to the invention is shown in FIG. 1, which is adjoined directly by a back region shown in FIG. 2. The arrangement is used for producing newspapers Z (FIG. 2), composed of one or several newspaper sections B (FIG. 1). The newspaper Z can be a newspaper in the so-called broadsheet format, meaning a standard large-format newspaper. The newspaper Z or at least one newspaper section B, however, can also be a newspaper in tabloid format. Newspapers in tabloid format have a smaller format and are stitched.

According to FIG. 1, the arrangement comprises a digital printer D, for example a laser printer or ink-jet printer. This digital printer D is used to print on both sides of a continuous paper web 1, in a manner that is known in the art. As a result, parts of a sheet can be successively printed on, so that a complete newspaper Z is obtained. For producing newspapers in the broadsheet format, the two sides of the paper web 1 are thus imprinted while upright, side-by-side. For newspapers in the tabloid format, two pages per section are printed one above the other and two pages are printed while positioned side-by-side. The digital printer D permits a rapid change between the two aforementioned formats, so that the newspaper Z can be composed of sections B in the broadsheet format and in the tabloid format.

The paper web 1 is conveyed in the region of a first conveying segment F1 with the aid of delivery rollers 2 and with a predetermined speed and tension. Behind these delivery rollers 2, the continuous paper web 1 is supplied to a crosscutter 3 which separates the continuous paper web 1 into sheets 4. The crosscutter 3 comprises a rotating blade 49 and a fixed blade 50, and can be a crosscutter that is known in the art. The sheets 4 are also full-sized sheets. To produce a section B in the broadsheet format, a sheet 4 of this type contains four pages, while it contains eight pages for a tabloid format. The cutting length for the sheet 4 is controlled by crosscutter 3. The cutting length of sheet 4 is a function the speed of the crosscutter 3.

The crosscutter 3 is operated by means of a drive, not shown herein, and is controlled by the printer D so that the sheets 4 are separated according to sequence. Essentially simultaneous with the separation operation, each sheet 4 that is cut off is also accelerated with the aid of a tear-off cylinder 5 or a different suitable device and is transported further with the aid of vacuum belts 6. As a result of this acceleration, a fixed separation of the forward-moving sheets 4 is achieved. The tear-off cylinder 5 has a higher circumferential speed (measured in mm/cycle) than the speed at which the sheets 4 are traveling on the conveyor, so that a predetermined gap 7 is created between respectively two sheets 4.

A centering device 8 is provided in the region of the first conveying segment F1, by which the sheets 4 can be aligned precisely on the side and can be transported further with the same timing and with the aid of belts 9, for example toothed belts. To ensure a secure transport and the aforementioned alignment on the side, a plurality of balls 10 are provided in the region of belts 9. Balls 10 are positioned in a band 52 and due to their inherent weight, push onto the sheets 4 and/or the belts 9 underneath.

The sheets 4, which are aligned and spaced-apart as explained above, are weakened in the center by means of scoring rollers 12 before being folded in a continuous folding apparatus 11. In the process, the sheets 4 are guided by intake belts 13 so that the sheets 4 are subsequently folded precisely along the weakened line while moving through the continuous folding apparatus 11. The intake belts 13 are somewhat slanted in a downward direction, relative to a horizontal line, as shown in FIG. 1. The same is true for the continuous folding apparatus 11. Dashed lines in FIG. 1 indicate two folded sheets 16 and 16'. The folding operation may be accomplished by using circulating profile belts 14 or other types of belts, wherein it is also conceivable to use a different type of folding apparatus. Examples of such folding operations are set forth in Swiss Patent CH 615 646 and or U.S. Pat. No. 4,221,373.

Upon leaving the continuous folding apparatus 11, the sheets 16 and/or 16' are pressed down respectively along the fold by vertical rollers 15, which results in a more accurate and sharper fold.

Figure 4:
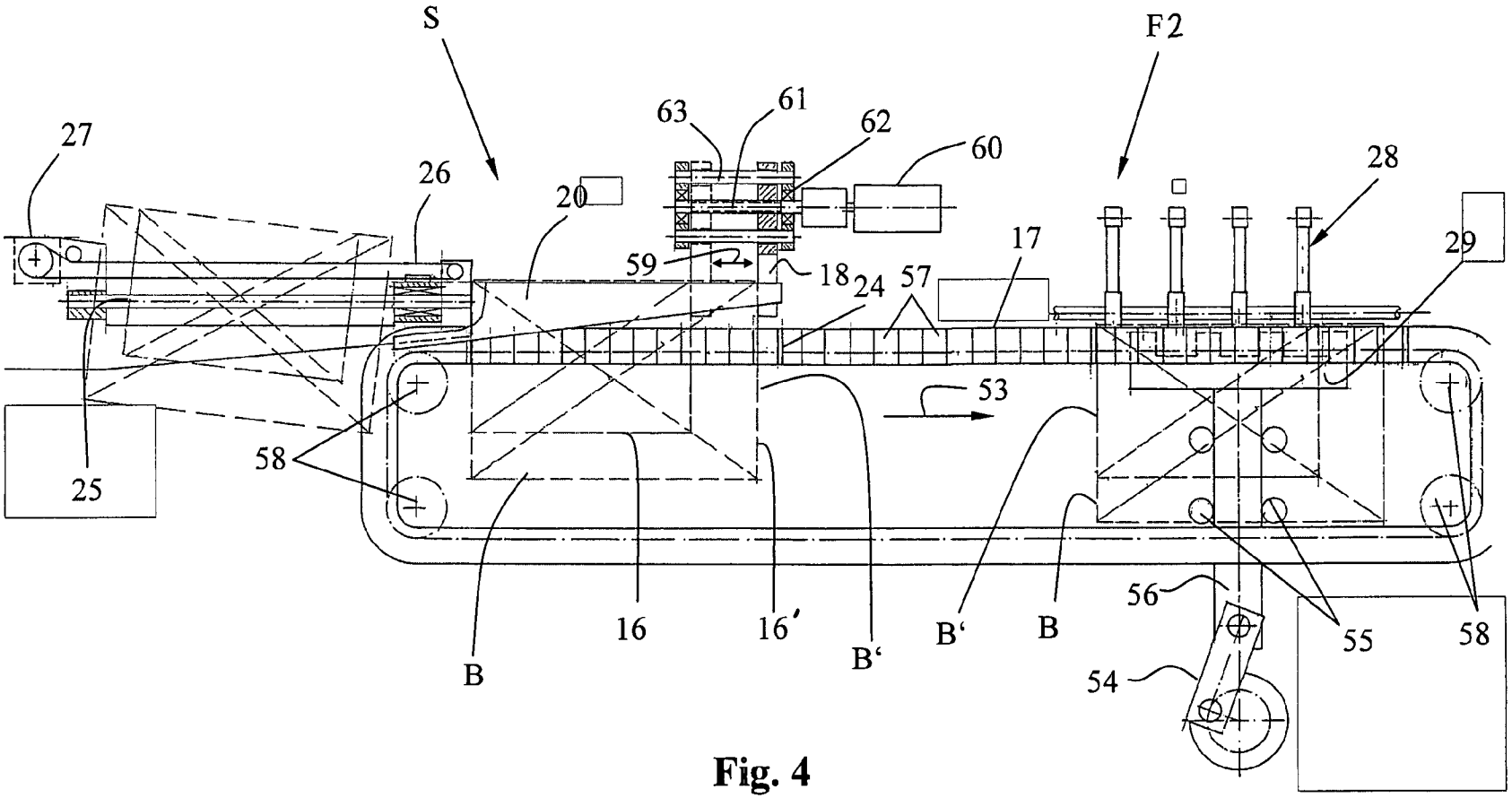
FIG. 4: An enlarged view of a different portion of the apparatus as depicted in FIG. 1.

The continuous folding apparatus 11 is followed by a second conveying segment F2, provided with a gathering station S in which the sheets 16 and/or 16' are gathered to form a complete newspaper section B and/or B'. In the embodiment illustrated in FIG. 1, gathering station S is located in an upstream location within second conveying segment F2. The second conveying segment F2 comprises an endless gathering chain 17, preferably an endless double chain which is known in the art. This chain comprises saddle-shaped elements 57, as shown in FIG. 4, as well as uniformly spaced-apart carriers 24. The gathering chain 17 is fitted around rollers 58 and is driven intermittently with a drive, not shown herein.

The upper segment of the gathering chain 17 moves from the left to the right as shown with arrow 53 in FIG. 4. FIG. 4 also shows that the gathering chain 17 is provided with an end stop 18, which can be adjusted to a limited degree in the directions of double arrow 59 with the aid of a thread spindle 61 that is positioned to rotate in a bearing 62 and is driven, for example, by motor 60. The end stop 18 is positioned to be displaceable along guide rods 63, wherein an adjustment to the format of the folded sheets 16 and/or 16' is possible by displacing the end stop 18. FIGS. 1 and 4 show a sheet 16 having a smaller format that a sheet 16'. A control unit, not shown herein, is used for the adjustment control. To reduce the impact between the sheets 16 and/or 16' and the end stop 18, the above-mentioned pressing rollers 15 (FIG. 1) can be operated with the aid of a servo motor that is not shown herein, such that the speed of sheets 16 and/or 16' is slowed just prior to leaving the pressing rollers 15.

The sheets 16 and/or 16' are gathered while the gathering chain 17 is standing still. The individual sheets can be gathered while positioned on top of each other or while inserted into each other. Once the newspaper section B and/or B' is fully assembled, a sword 20 is extended in the conveying direction to the position shown in FIG. 4, causing the following sheets 16 and/or 16' to drop onto this separating sword 20 and be held back. At the same time, the newspaper section B and/or B' formed on the gathering chain 17 is conveyed from the left to the right as shown in FIG. 4. The newspaper section B and/or B' is conveyed just far enough to reach the partition 22 shown in FIG. 1, whereupon the separating sword 20 is pulled back again, causing the sheets 16 and/or 16' that have collected on the separating sword 20 to fall onto the gathering chain 17, which is again standing still. The additional sheets 16 and/or 16' subsequently drop once more directly onto the stopped gathering chain 17 and/or onto the sheets 16 and/or 16' already positioned thereon, until an additional newspaper section B and/or B' is completely assembled. The dual gathering chain 17 is then started once more and the separating sword extended.

The newspaper sections B and/or B' are transported on the gathering chain 17 with the aid of the aforementioned carriers 24 against which the sections B and/or B' come to rest. The separating sword 20 moves inside a linear guide 25 and is moved back and forth substantially in horizontal direction by a toothed belt 26, driven with a servomotor 27.

Figure 5:
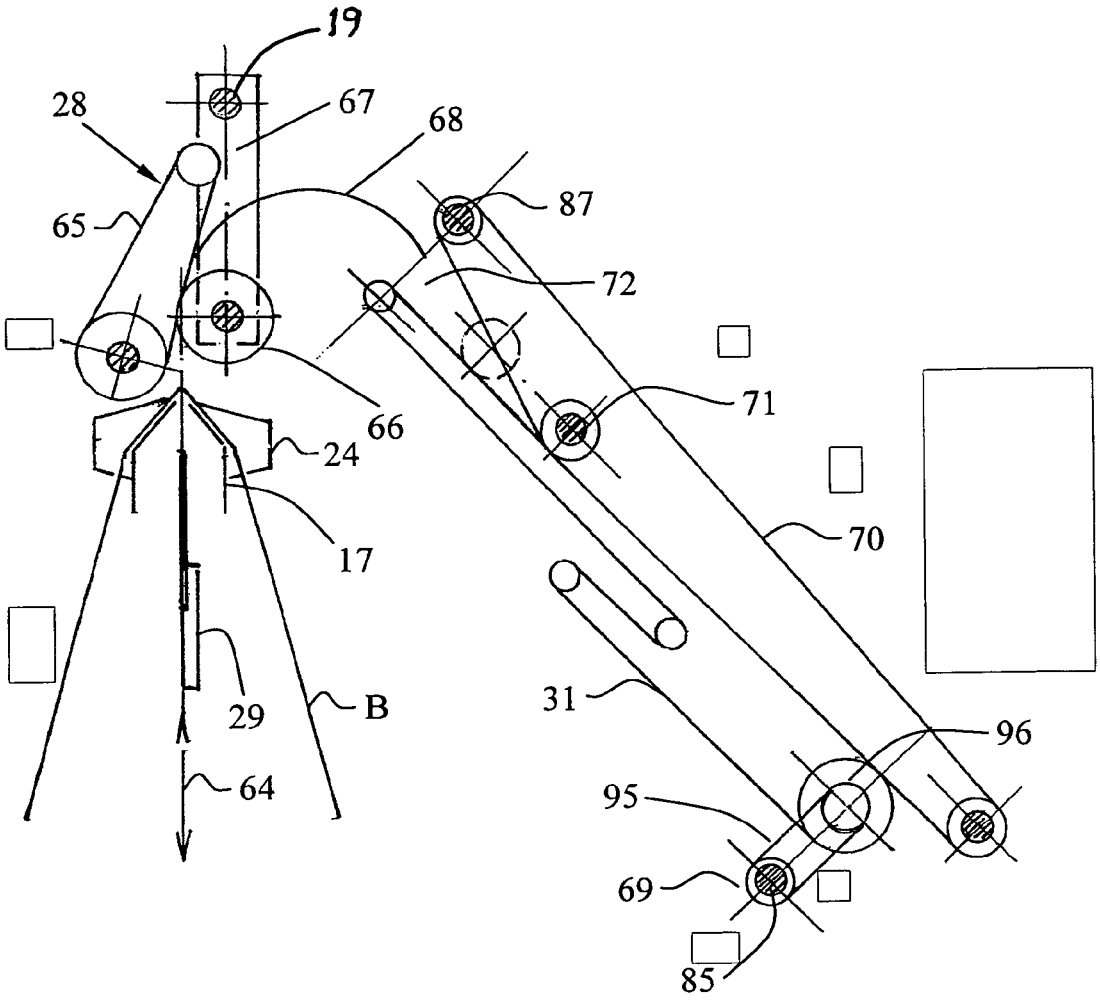
FIG. 5: An enlarged view of a portion of the back region of the apparatus as depicted in FIG. 2.

At the end of the first conveying segment F1, the newspaper section B and/or B' is supplied by a delivery device 28, shown in greater detail in FIG. 5, to the following processing unit. In accordance with embodiments of the invention, the delivery device 28 acts as an inserting device. The delivery device 28 is provided with an ejection comb 29, which can be moved substantially vertically in the directions of double arrow 64, as shown in FIG. 5. The ejection comb lifts the newspaper section B and/or B' from the gathering chain 17 and pushes it between a belt 65 and a roller 66, which move the newspaper section B and/or B' in upward direction, where it is redirected by a curved sheet metal guide 68 and is supplied to the belts 31 and round cords 70. The ejection comb 29 is operated by means of a drive 54 and comprises a rod 56 that is guided on rolls 55 (See FIG. 4). The roller 66 is positioned on a suspension 67, which can be pivoted around an axis 19, so that the roller 66 can be adapted to different thicknesses of the newspaper section B and/or B', wherein the contact pressure can additionally be adjusted.

Figure 6:
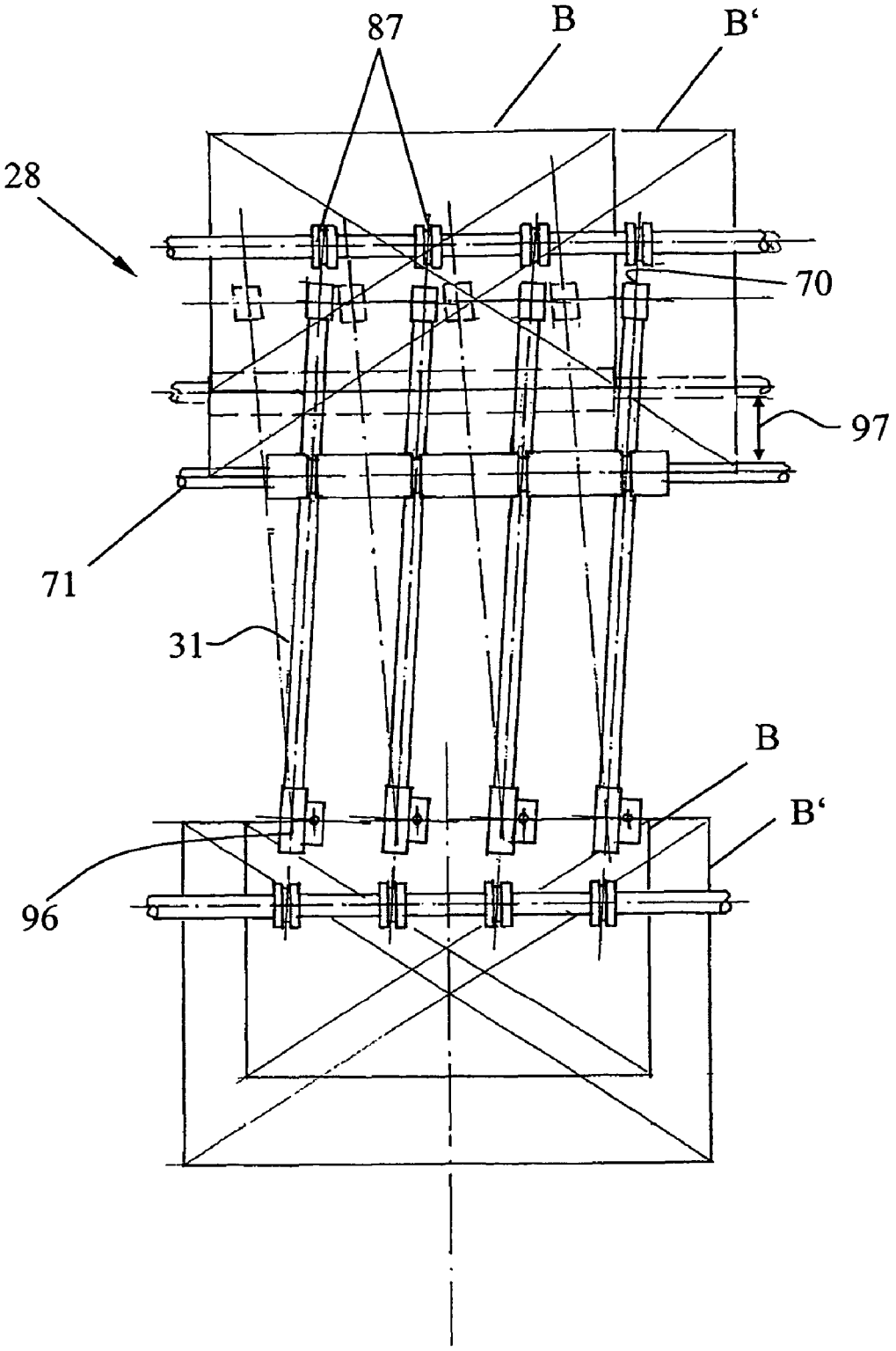
FIG. 6: A different view of the apparatus as depicted in FIG. 5.

The belts 31 and the cords 70 can be swiveled as shown in FIG. 6 so that the section B and/or B' can be oriented centrally for the further stitching and folding operation, as mentioned below. The belts 31 are driven with the aid of a drive shaft 69, which acts via toothed belts 95 upon pivoting rollers 96 around which belts 31 are fitted. For the adaptation to different formats, a contact roller 71 can be displaced as shown with double arrow 97 (FIG. 6). The cords 70 run on grooved rollers 87. The drawing at the top of FIG. 6 shows the section B and/or B' prior to the orientation while the drawing at the bottom shows the section in the oriented position. However, other means that are known in the art can also be used for orienting the section B and/or B'. During the orienting, the section B and/or B' moves downward at a slant, as shown in FIG. 5. Due to the fact that the section B and/or B' is held by cords 70, a horizontal transport would also be conceivable, which has the advantage of a lower structural height.

Figure 7:
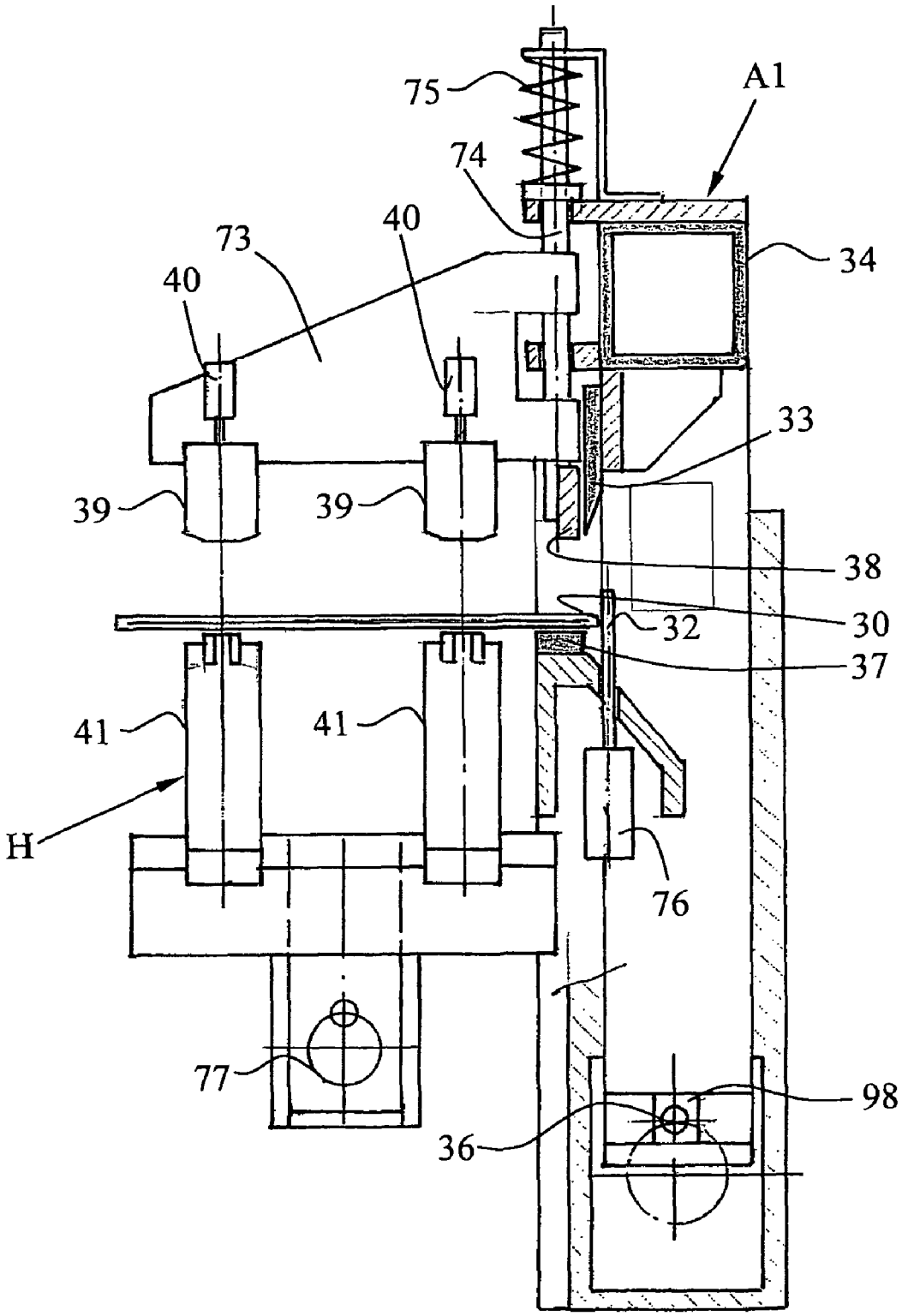
FIG. 7: An enlarged view of a portion of the apparatus as depicted in FIG. 2.

The centrally oriented section B and/or B' is then supplied to a first work station Al (see FIGS. 2 and 7) where it slides under the force of gravity and aligns itself as a result of its inherent weight with its fold against a stop element 32. The stop element 32 is operated, for example, with the aid of a pneumatic cylinder 76. The work station A1 shown in FIG. 2 is positioned at an angle and, for drawing reasons, is shown upright in FIG. 7. As shown in FIG. 2, the transporting plane for the newspaper section B and/or B' in the work station A1 points downward at an angle. Relative to a horizontal line, this angle is more than 10°, preferably more than 20°, and especially preferred approximately 30°. Owing to this angle and its inherent weight, the section B and/or B' can align itself along the folding edge, as explained below.

The first work station A1 is used for trimming and/or stitching the newspaper section B if this section is intended for producing a tabloid.

Figure 8:
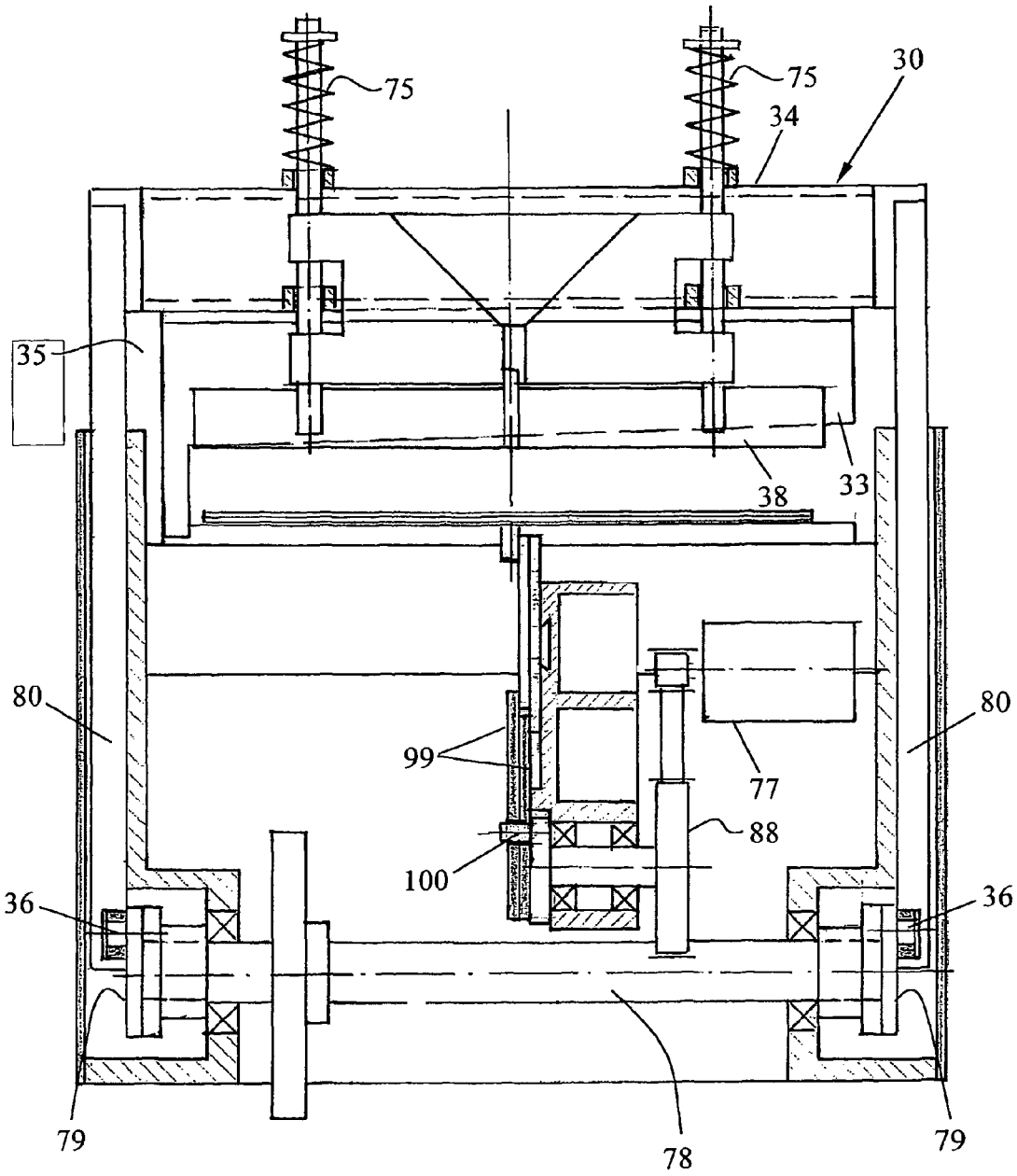
FIG. 8: A different view of the apparatus as depicted in FIG. 7.

The work station A1 comprises a trimming device with a vertically moving knife 33 and a stationary counter knife 37. According to FIGS. 7 and 8, the moving knife 33 is attached to a yoke 34, in a manner known in the art, and is moved vertically by means of pull and guide rods 80. The pull and guide rods 80 move along guide elements 35 and engage via a slide ring 98 in a crankshaft pin 36. The two crankshaft pins 36 are attached to an eccentric cam 79 of a drive shaft 78. The yoke 34 is driven intermittently and is idle while in the upper position shown in FIGS. 6 and 7. The section B is trimmed, as mentioned in the above, along its section fold 30, wherein the knife 33 and the counter knife 37 in this case function in the manner of a pair of scissors.

A crosshead 38 of a press is arranged on the yoke 34, which pushes under the effect of springs 75 onto the section B prior to the cutting operation, so that a clean cut can be made. Following the trimming operation, the press crosshead 38, which is attached to guide rods 74, is again moved upward and into the idle position shown in FIGS. 7 and 8. In place of a single newspaper section B, several folded newspaper sections can also be gathered, trimmed, and then stitched as explained in the following.

The newspaper section B can be stitched with a stitching unit H provided with two stitching heads 41 and two bending units 39. As can be seen, the stitching heads 41 are arranged below the conveying segment F2, which convey section B, and the bending units 39 are arranged above conveying segment F2. One stitching head 41 operates jointly with a bending unit 39, which can be accomplished in a manner known in the art. Wire staples, which are known in the art and are not shown herein, are used for the stitching in this case. The bending units 39 are attached to a support 73 that is connected to the press crosshead 38 and is moved in vertical direction along with this crosshead. When the press crosshead 38 is lowered, the bending units 39 are lowered at the same time and are pressed against the section B. As a result, the bending units 39 are automatically adjusted to the thickness of the newspaper section B and are thus always in the optimum position for the stitching operation. The bending units 39 are provided with standard bending wings for closing the wire staples, which are not shown herein. These bending wings are operated with the aid of a pneumatic cylinder 40.

The stitching heads 41, which are positioned below and operate jointly with the bending units 39 as mentioned in the above, are driven separately from the knife 33 by a motor 77. Each stitching head 41 is provided with connecting members 99, which are activated by a crankshaft pin 100. The interaction of the stitching head 41 with the connecting members 99 an be accomplished in a manner known to one of skill in the art. The press crosshead 38 and the knife 33 preferably have a considerably higher lift than would be necessary for trimming the newspaper section B. As a result, even a newspaper section B that is not pressed down optimally can move without problem underneath the bending units 39 and the press crosshead 38, as well as the knife 33, and can come to rest and align itself against the stop element 32.

As previously mentioned, only newspaper sections B for producing tabloids are trimmed and stitched in the first work station Al. If the newspaper section B is used to produce a newspaper Z in the broadsheet format, this newspaper section B is neither trimmed nor stitched, but only comes to rest against the stop element 32, wherein the knife 33, the press crosshead 38, and the bending units 39 are immovable in the upper position, shown in FIGS. 7 and 8.

Figure 9:
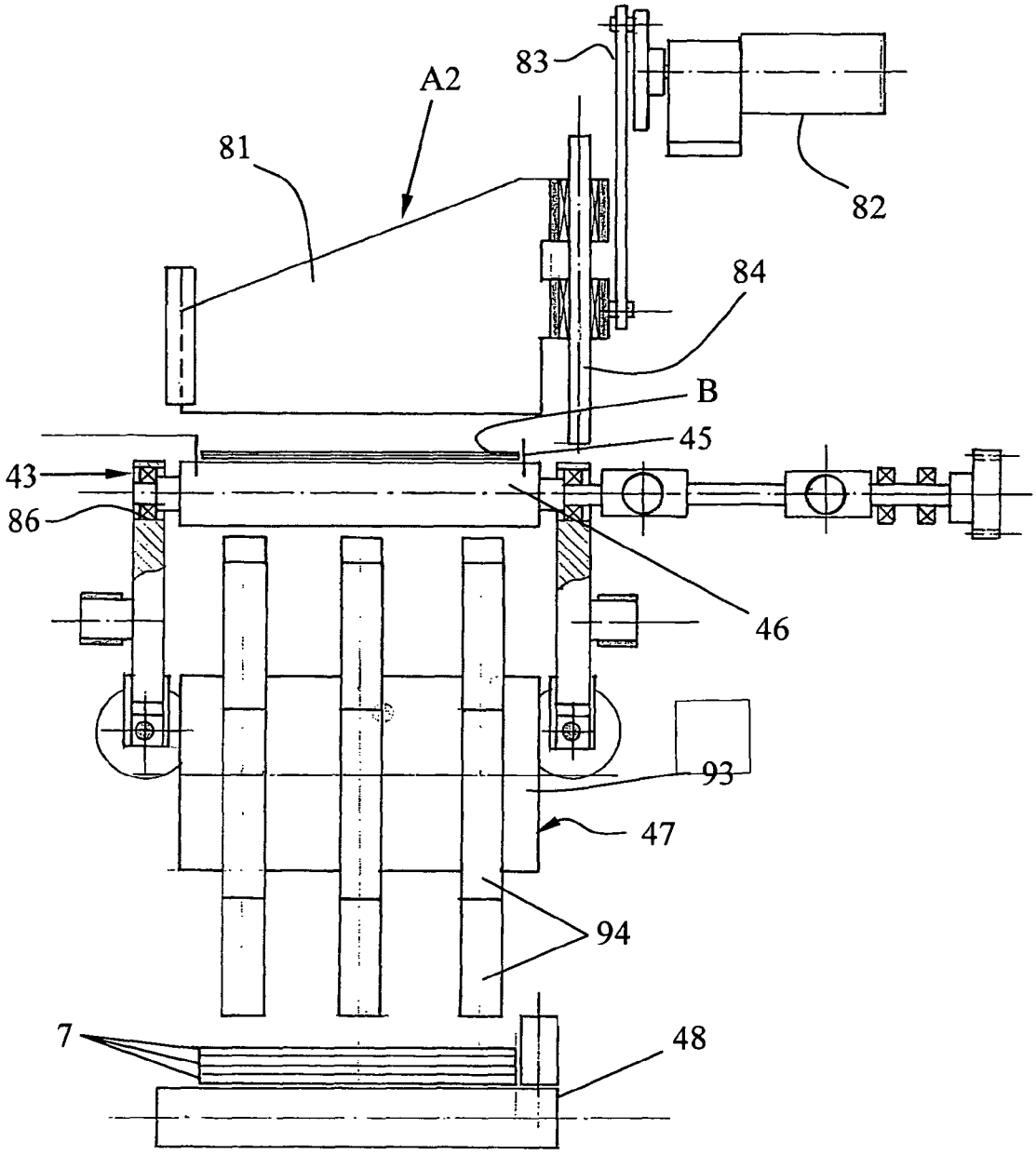
FIG. 9: An enlarged view of another portion of the apparatus as depicted in FIG. 2.
Figure 10:
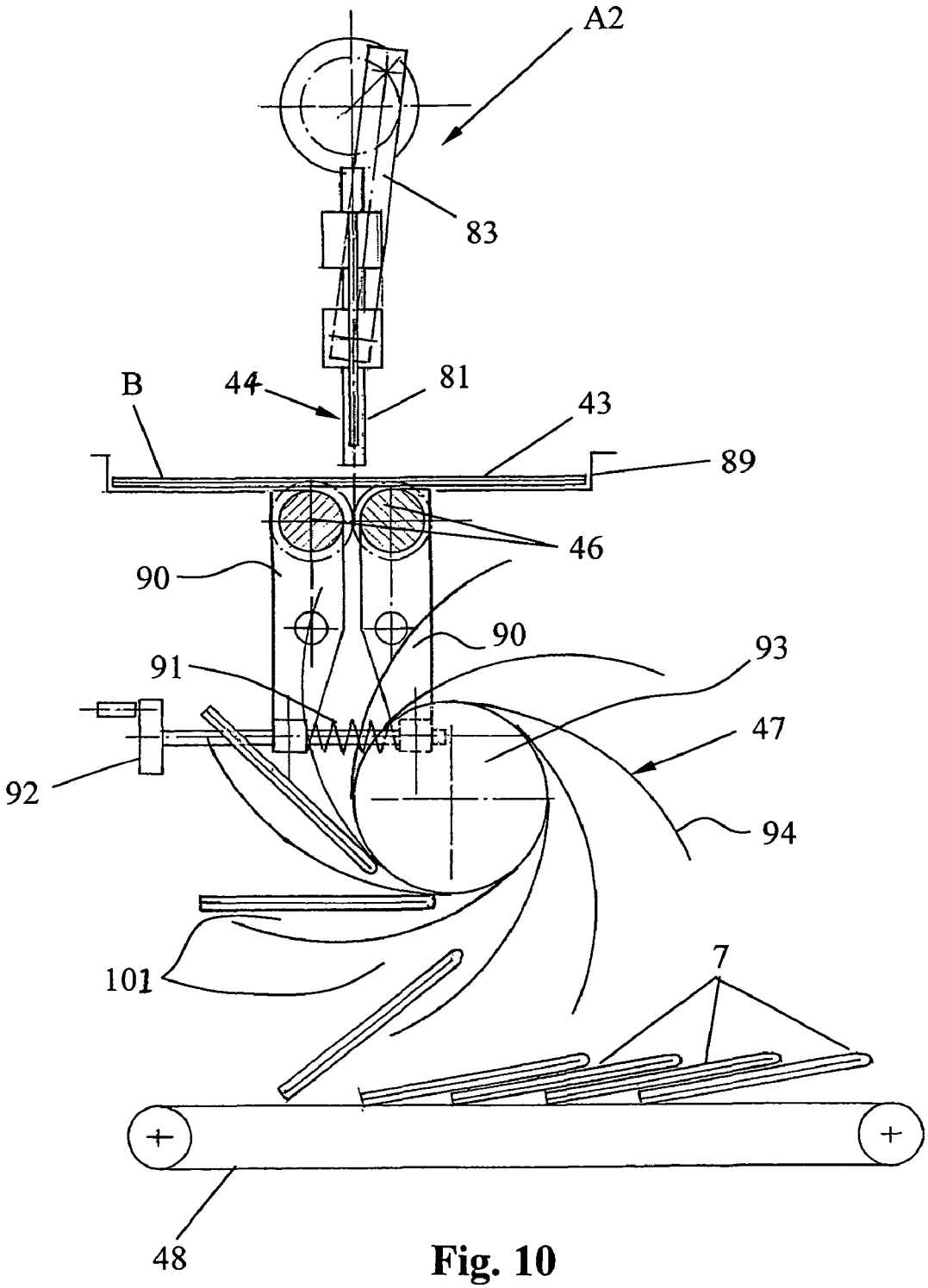
FIG. 10: A different view of the apparatus as depicted in FIG. 9.

Following the stitching and trimming of the section B, insofar as it takes place, the stop element 32 is lowered by activating a pneumatic cylinder 36 and the newspaper section B slides as a result of its inherent weight down the above-mentioned inclined path, shown in FIG. 2, by way of a ramp 42 and into the second work station A2 with folding apparatus 43, shown in FIGS. 9 and 10. The section B continues to slide until it reaches an end stop 45 (FIG. 9) that is arranged above two press-on rollers 46. When sliding into the second work station A2, the newspaper section B is centered on the side, relative to the two press-on rollers 46, by the sheet metal guide 89 shown in FIG. 10. The two press-on rollers 46 operate jointly with a folding knife 81, which is positioned on a vertical guide rod 84, such that it can move vertically up and down. A crankshaft 83, controlled by a drive 82, is used to control the vertical movement of the folding knife 81. The folding knife 81 acts upon the center of the newspaper section B to push the section between press-on rollers 46 that move toward each other. These press-on rollers 46 are each positioned on a two-arm lever 90, as shown in FIG. 10, and are pressed against each other with the aid of a spring 91. The newspaper section B is thus folded in the center with the aid of the two press-on rollers 46 and/or is provided with a fold. The force of the spring 91 and thus also the press-on force of the press-on rollers 46 can be adjusted with an adjustment device 92, which permits the adaptation to differently thick newspaper sections.

Several newspaper sections B and/or B' can also be gathered above the two press-on rollers 46 in place of a single newspaper section B and/or B', and these can subsequently be folded jointly with the aid of the folding sword 44. For producing a newspaper in the broadsheet format with a section B and/or B', the fold is the second fold which extends at a right angle to the above-mentioned first fold. For a tabloid, on the other hand, only a single fold is formed along the staples in the center.

The folded newspaper section B is moved downward through the moving press-on rollers 46 and is supplied via a star-shaped delivery 47 to a delivery belt 48. FIG. 10 shows that the star-shaped delivery 47 is provided with a drum 93, having several metal sheets 94 attached thereto, which are provided with pockets 101 for accommodating at least one newspaper section B and/or B'. The newspapers Z are transported further on this delivery belt 48, for example in the form of an overlapping stream. The star-shaped delivery 47, or a different delivery device, can be embodied so that several newspaper sections B and/or B' are combined, for example inserted into each other, wherein a pocket 101 is used for the insertion. To accomplish the insertion, a first section B and/or B' is positioned open-faced and pointing upward inside pocket 101. Second section B and/or B' can then be inserted from above into the first section. By this process, more than two sheets B and/or B' can also be fitted into each other to produce very thick newspapers Z. Therefore, newspapers Z according to FIG. 10 can comprise several newspaper sections B. A newspaper Z can also comprise one or several sections B in the broadsheet format and one or several sections B in the tabloid format, meaning extremely thick newspapers Z can thus be produced. The trimmed tabloids can have different dimensions and/or formats, which is also true for the newspaper sections B in broadsheet format.

It will be understood that the above description of the present invention is susceptible to various modifications, changes and adaptations, and the same are intended to be comprehended within the meaning and range of equivalents of the appended claims.

What is claimed is:

1. A method for producing a digitally printed product that includes at least one section of sequentially printed sheets folded approximately in the center, the method comprising:

sequentially printing a continuous paper web with a printer;

cutting the continuous paper web with a crosscutter to form the sequentially printed sheets;

folding the sequentially printed sheets, which are conveyed one after another on a conveying device, inside a folding apparatus to form a first fold;

gathering the folded sheets in a gathering station to form a stack; and feeding the stack to a work station and folding the section in the work station approximately in the center to form a second fold.

2. The method according to claim 1, further comprising separating the sheets on a first conveying segment.

3. The method according to claim 2, further comprising centering the sheets on one side inside a centering device following the separation.

4. The method according to claim 1, further comprising weakening the sheets in the center to form a fold when the sheets enter the folding apparatus.

5. The method according to claim 1 , further comprising gathering the sheets in the gathering station to form a gathered stack when the conveying device is stopped.

6. The method according to claim 5, further comprising pushing the sheets on the conveying device against an adjustable end stop.

7. The method according to claim 5, wherein the conveying device is a gathering chain.

8. The method according to claim 5, further comprising lifting the gathered stack from the conveying device with an ejection comb and supplying the gathered section to a processing unit.

9. The method according to claim 1, further comprising gathering the individual sheets on the conveying device while the sheets are positioned one on top of the other or while the sheets are inserted into each other.

10. The method according to claim 1, further comprising installing a delivery device upstream of the work station and an aligning mechanism downstream of the delivery device for aligning the stack relative to the work station.

11. The method according to claim 1, wherein the second fold is formed at a right angle to the first fold.

12. The method according to claim 1, further comprising trimming and/or stitching the section along a section fold in the work station.

13. The method according claim 12, wherein the work station includes a first work station and a second work station, wherein the step of trimming and/or stitching the section occurs in the first work station and the step of folding the section occurs in the second work station.

14. A method for producing a digitally printed product that includes at least one section of sequentially printed sheets folded approximately in the center, the method comprising:

folding the sequentially printed sheets, which are conveyed one after another on a conveying device, inside a folding apparatus to form a first fold;

gathering the folded sheets in a gathering station to form a completely gathered stack;

holding back folded sheets in the gathering station with an extendable sword until the completely gathered stack on the conveying device is transported further along the conveying device; and feeding the stack to a work station and folding the section in the work station approximately in the center to form a second fold.

15. A method for producing a digitally printed product that includes at least one section of sequentially printed sheets folded approximately in the center, the method comprising:

folding the sequentially printed sheets, which are conveyed one after another on a conveying device, inside a folding apparatus to form a first fold;

gathering the folded sheets in a gathering station to form a stack;

sliding the stack to be processed into a work station under the force of gravity and stopping the section against a stop element;

trimming and/or stitching the section along a section fold in the work station and folding the section approximately in the center to form a second fold.

16. The method according to claim 15, wherein the work station includes a first work station and a second work station, and the sliding step occurs in the first work station and the step of folding the section occurs in the second work station.

17. The method according to claim 15, further including making the second fold at a right angle to the first fold to produce the print product in a broadsheet format.

18. An arrangement for producing a digitally printed product that includes at least one section of sequentially printed sheets, the arrangement comprising:

a first conveying segment including a crosscutter to cut a continuous printed-on paper web to form the sequentially printed sheets;

a conveying device to convey one after another the printed sheets;

a folding apparatus installed downstream of the first conveying segment to sequentially fold the printed sheets to form a first fold;

a gathering station to gather the folded sheets to form a stack; and a work station to which the stack is fed, the work station including a folding device to form a second fold approximately in the center folded print product.

19. The arrangement according to claim 18, wherein the first conveying segment comprises a means for generating a gap between the individual sheets, the generating means being located downstream of the crosscutter.

20. The arrangement according to claim 19, wherein the first conveying segment further comprises a centering device for centering the sheets on one side, the centering device being located downstream of the generating means.

21. The arrangement according to claim 18, further comprising grooved rollers located upstream of the folding apparatus to form a weakening line.

22. The arrangement according to claim 18, wherein the gathering station comprises an intermittently driven gathering chain.

23. The arrangement according to claim 18, further comprising a separating sword located above the gathering station, wherein the sword can be extended in the conveying direction.

24. The arrangement according to claim 18, wherein the work station comprises a trimming device and/or a stitching apparatus.

25. The arrangement according to claim 18, wherein the work station includes a stitching apparatus that includes at least one stitching head located below a conveying segment for the sections to be stitched, and at least one bending apparatus located above the stitching head.

26. The arrangement according to claim 18, wherein the work station further comprise a slanted conveying segment and a stop element at the end of a slanted conveying segment.

27. The arrangement according to claim 26, wherein the conveying segment is slanted at an angle of at least 10° relative to a horizontal line.

28. The arrangement according to claim 26, wherein the conveying segment is slanted at an angle of about 30° relative to a horizontal line.

29. The arrangement according claim 18, wherein the work station includes a first work station and a second work station following the first work station, the second work station including the folding device.

30. The arrangement according to claim 29, wherein the folding device includes a delivery device.

31. The arrangement according to claim 18, wherein the folding device forms the second fold at a right angle to the first fold.

32. An arrangement for producing a digitally printed product that includes at least one section of sequentially printed sheets, the arrangement comprising:

a conveying device to convey one after another the printed sheets;

a folding apparatus to sequentially fold the printed sheets to form a first fold;

a gathering station to gather the folded sheets to form a stack; and a work station to which the stack is fed, the work station including a folding device to form a second fold approximately in the center folded print product, wherein the work station comprises a trimming device that includes a press crosshead.

33. The arrangement according claim 32, wherein the work station includes a first work station and a second work station following the first work station, the second work station including the folding device and the first work station including the trimming device.

34. An arrangement for producing a digitally printed product that includes at least one section of sequentially printed sheets, the arrangement comprising:

a conveying device to convey one after another the printed sheets;

a folding apparatus to sequentially fold the printed sheets to form a first fold;

a gathering station to gather the folded sheets to form a stack; and a work station to which the stack is fed, the work station including a folding device to form a second fold approximately in the center folded print product, wherein the work station includes a first work station and a second work station following the first work station, the second work station including a folding device, and wherein the folding device includes a delivery device comprising an inserting device.

* * * * *